US008430290B2

(12) United States Patent
Tebo

(10) Patent No.: US 8,430,290 B2
(45) Date of Patent: Apr. 30, 2013

(54) SYSTEM AND METHOD FOR DRIVING A FASTENER

(76) Inventor: Glenn J. Tebo, Kingston, NH (US)

( * ) Notice: Subject to any disclaimer, the term of this patent is extended or adjusted under 35 U.S.C. 154(b) by 768 days.

(21) Appl. No.: 11/912,567

(22) PCT Filed: Apr. 26, 2006

(86) PCT No.: PCT/US2006/015742

§ 371 (c)(1),
(2), (4) Date: Jun. 24, 2008

(87) PCT Pub. No.: WO2006/116464

PCT Pub. Date: Nov. 2, 2006

(65) Prior Publication Data

US 2009/0166391 A1 Jul. 2, 2009

Related U.S. Application Data

(60) Provisional application No. 60/674,772, filed on Apr. 26, 2005.

(51) Int. Cl.
*B27F 7/00* (2006.01)

(52) U.S. Cl.
USPC ..... 227/120; 227/15; 227/16; 227/107; 227/109; 227/119

(58) Field of Classification Search ..... 227/15–16, 227/18, 107, 109, 119, 120
See application file for complete search history.

(56) References Cited

U.S. PATENT DOCUMENTS

| | | | | |
|---|---|---|---|---|
| 2,314,481 | A * | 3/1943 | Crooks | 52/718.02 |
| 3,260,437 | A * | 7/1966 | Parr | 227/149 |
| 3,820,705 | A * | 6/1974 | Beals | 227/113 |
| 3,834,602 | A * | 9/1974 | Obergfell | 227/120 |
| 4,319,706 | A | 3/1982 | Halstead | |
| 4,389,012 | A | 6/1983 | Grikis et al. | |
| 4,470,531 | A | 9/1984 | Anstett | |
| 4,903,880 | A | 2/1990 | Austin et al. | |
| 5,873,509 | A * | 2/1999 | Liao | 227/109 |
| 5,927,923 | A | 7/1999 | Tebo | |
| 6,076,720 | A * | 6/2000 | Deng | 227/109 |
| 6,279,808 | B1 * | 8/2001 | Larsen | 227/119 |
| 6,789,718 | B2 * | 9/2004 | Canlas et al. | 227/130 |
| 2004/0050899 | A1 | 3/2004 | Canlas et al. | |
| 2004/0112933 | A1 * | 6/2004 | Lamb | 227/18 |
| 2005/0224555 | A1 * | 10/2005 | Kirby et al. | 227/134 |
| 2006/0169735 | A1 * | 8/2006 | Wen | 227/8 |
| 2008/0156844 | A1 * | 7/2008 | Braganza et al. | 227/109 |

OTHER PUBLICATIONS

Canadian Office Action mailed Sep. 18, 2012 in connection with related Canadian Patent Application No. 2,605,885.
Examiner's Report dated Nov. 25, 2010 issued in related Australian Patent Application No. 2006241155.

* cited by examiner

*Primary Examiner* — Brian D Nash
*Assistant Examiner* — Michelle Lopez
(74) *Attorney, Agent, or Firm* — Grossman, Tucker, Perreault & Pfleger, PLLC

(57) ABSTRACT

An apparatus for driving a fastener (1300) including a nose (1202) having a passageway including a first channel portion (1204) and a second channel portion (1214). The first channel portion is adapted to receive a first fastener body portion (1302) and the second channel portion adapted to receive a second fastener body portion (1304). The first and second fastener body portions are obliquely angled relative to one another. The apparatus also includes a driver blade (120) configured to apply a force to a first end of the fastener for driving the fastener at least partially from the passageway.

19 Claims, 11 Drawing Sheets

FIG. 3
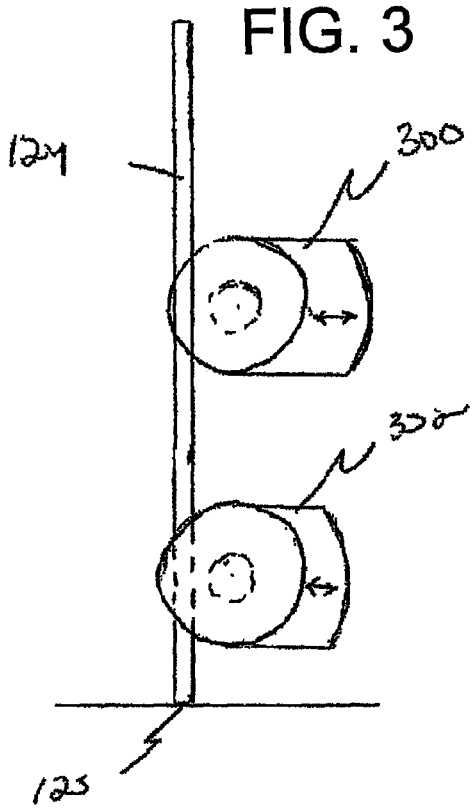
FIG. 4
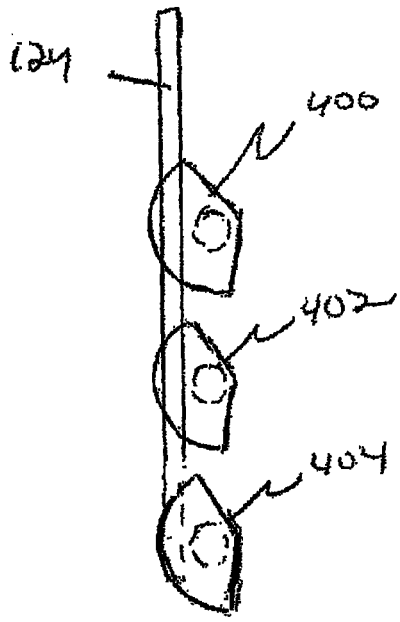
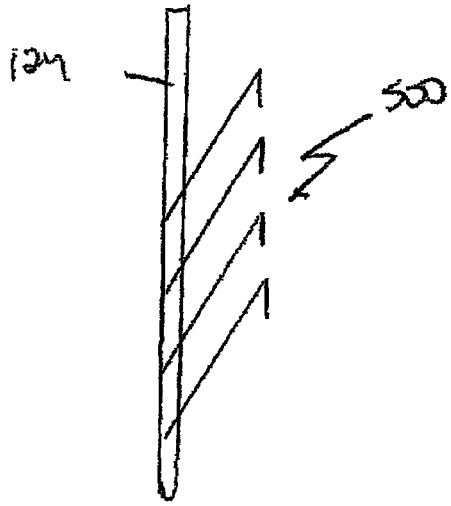
FIG. 5
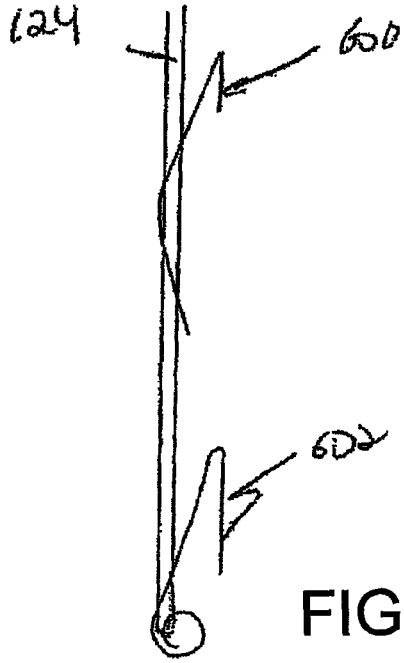
FIG. 6

SYSTEM AND METHOD FOR DRIVING A FASTENER

CROSS-REFERENCE TO RELATED APPLICATIONS

This application claims the benefit of U.S. provisional patent application Ser. No. 60/674,722, filed Apr. 26, 2005, the entire disclosure of which is incorporated herein by reference.

FIELD

The present invention relates in general to fasteners, and, more particularly, to a system and method for driving a fastener.

BACKGROUND

A wide variety of fastener configurations for securing structural members to other members are known. In one example, a deck fastener may be used for securing decking members to associated joists in the construction of an exterior deck, or the like. It is desirable that deck fasteners be configured for securing decking members to associated joists without a fastener head protruding from a deck surface. An example of a fastener having such a configuration is described in U.S. Pat. No. 5,927,923 (hereinafter "923 patent"), which is incorporated herein by reference. Fasteners as described for example in the '923 patent have an irregular geometric configuration including multiple body/prong portions angularly oriented relative to each other.

As a result of the irregular geometric configuration of such fasteners they have been driven manually without the use of a guiding tool or automated driving tool such as a pneumatic nailer. To achieve improved efficiency in driving such fasteners, there is a need for an improved system and method for driving such fasteners and a method of collating such fasteners.

BRIEF DESCRIPTION OF THE DRAWINGS

For a better understanding of the present invention, together with other objects, features and advantages, reference should be made to the following detailed description which should be read in conjunction with the accompanying figures, wherein:

FIG. 3 is a schematic illustration of an embodiment including rollers for guiding a fastener in a system consistent with the present invention;

FIG. 4 is a schematic illustration of an embodiment including cam features for guiding a fastener in a system consistent with the present invention;

FIG. 5 is a schematic illustration of a first embodiment including spring members for guiding a fastener in a system consistent with the present invention;

FIG. 6 is a schematic illustration of a second embodiment including spring members for guiding a fastener in a system for driving a fastener consistent with the present invention;

DETAILED DESCRIPTION

For ease of explanation, systems consistent with the invention may be shown and described herein in connection with the fastener described in the '923 patent. For example, a fastener 123 may include a long body 135 and a short body 134, which may be obliquely angled relative to one another, i.e., at an angle that is neither parallel nor perpendicular. It will be recognized, however, a system and method consistent with the present invention will be useful in connection with a wide variety of fastener configurations. In addition, exemplary embodiments may be described herein in connection with fastening of decking members to associated joists. It is to be understood, however, that a system and method consistent with the invention may be useful in connection with fasteners configured for use with any type of material including wood, composite materials, concrete, metal, plastic, textiles and other materials. The exemplary embodiments described herein are thus provided only by way of illustration, and are not intended to be limiting.

Figure 1:
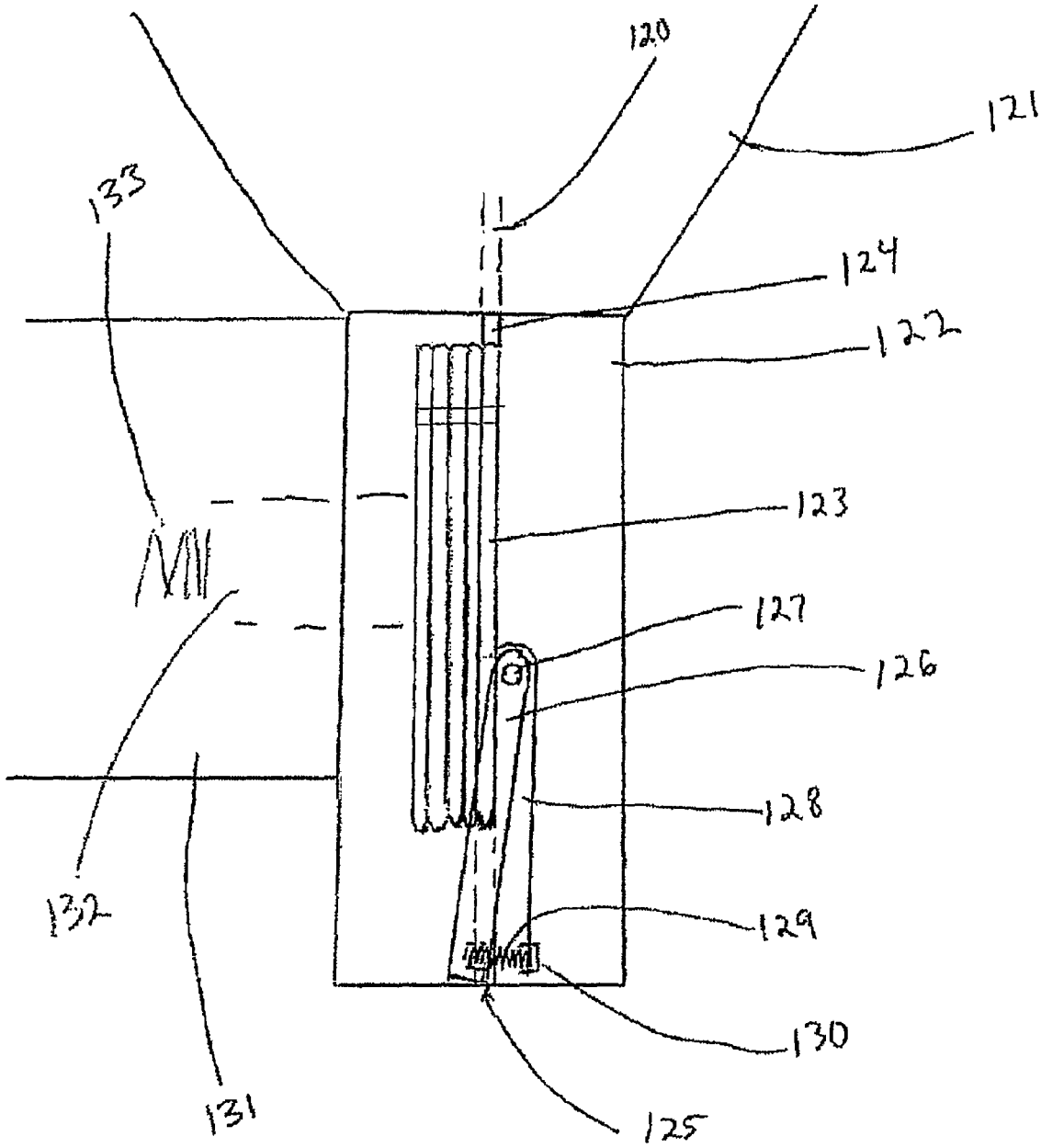
FIG. 1 is a side, partial sectional view of one exemplary embodiment of a system for driving a fastener consistent with the present invention.

Turning to FIG. 1, there is illustrated one exemplary embodiment of a system for driving a fastener consistent with the present invention. The system includes a tool body 121 which is only partially shown. The tool body 121 may be the body of a commercially available tool for driving a driver blade 120. The tool may be configured for driving the blade 120 outward from the tool body 121 using pneumatic, electrical, manual or other means. In one exemplary embodiment, the tool may be a commercially available pneumatic nailer.

In the illustrated exemplary embodiment, a nose or adapter 122 is affixed, e.g. removably, to the tool body. The nose 122 includes a channel 124 for receiving the driver blade 120 as the driver blade is forced outwardly from the tool body 121. A fastener 123 may be positioned in the channel 124 beneath the driver blade 120. As the driver blade 120 is forced outwardly from the tool body, the blade 120 may contact the top of the fastener 123 to force the fastener outward from the end 125 of the channel and into a target, such as a decking member, positioned beneath the nose 122. As will be recognized by those of ordinary skilled in the art, the tool may be configured to provide or impart a desired level of force to the fastener through the blade to achieve a desired depth of penetration of the fastener into the target member.

The fastener 123 may be positioned in the channel 124 by pusher 132 which may be biased against one or more fasteners, e.g., by an associated spring 133. The pusher 132 and the spring 133 may be assembled in a magazine 131 for receiving a plurality of fasteners. The pusher 132 may engage the last of a group of fasteners, e.g. as shown in FIG. 1, and the magazine 131 may guide the fasteners into the channel 124 under the bias force of the spring 133. The magazine 131 may be configured to direct the fasteners into the channel 124 from either side of the tool or the front or back of the tool.

Figure 2:
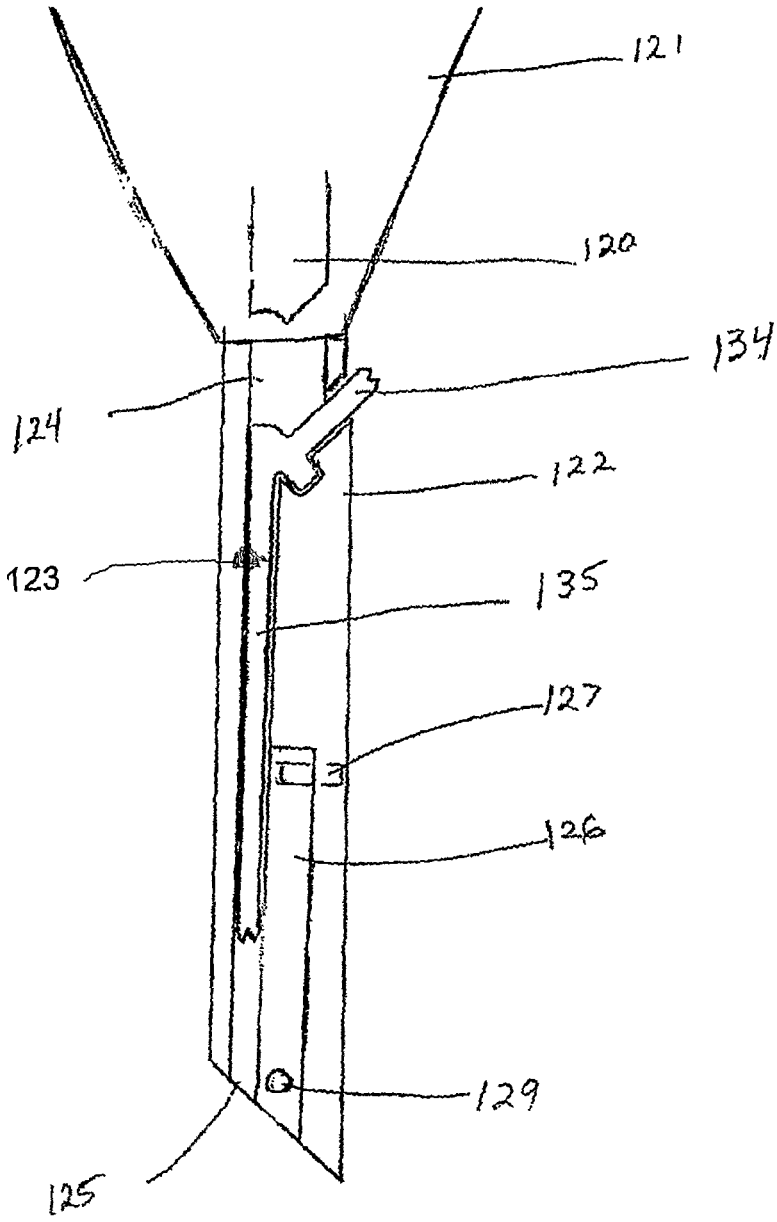
FIG. 2 is front, partial sectional view of the system of FIG. 1.

With reference also to FIG. 2, the adapter 122 may include a guide member 126. A top portion of the guide member 126 may be pivotally secured to the adapter 122 by a fastener 127 such as a screw, bolt, pin or rod. A bottom portion of the guide member adjacent the bottom 125 of the channel 124 may be biased by a spring 129 to intersect a portion of the channel 124. One end of the spring may be coupled to the guide member and the other end may be disposed in an opening 130 formed in a pocket 128 for receiving the guide member. When bias force of the spring 129 is overcome, the bias member may be forced into the pocket 130 and may not intersect the channel 124.

As shown, the guide member 126 may be biased to intersect only a portion of the channel 124 to allow the driver blade 120 to force a long body 135 of the fastener 123 past the guide member without forcing the guide member 126 into the pocket 128. As the fastener 123 is forced downward, a short body 134 of the fastener may contact the guide member 126. The guide member 126 may guide the short body 134 through the channel 124 under the force of the spring 129. As the short body 134 of the fastener exits the nose, the guide member 126 may be forced completely out of the path of the fastener 123 and into the pocket 128.

In the foregoing manner, when the guide member 126 is positioned to intersect a portion of the channel 124, an opening may be defined which may be generally complimentary to the geometry of the long body 135. The opening defined by the channel 124 and the guide member 126 may at least partially restrict the movement of the fastener 123 other than generally along the axis of the channel 124. The fastener 123 may, in the foregoing manner, resist becoming cocked within the channel 124, or otherwise moving out of a desired alignment relative to the nose 122.

The guide member 126 may be provided in a variety of configurations, and may include one or more guiding components. FIG. 3, for example, illustrates first 300 and second 302 spring biased rollers which may act as guide members. The rollers 300, 302 may intersect at least a portion of the channel 124. Similar to the previous embodiment, the rollers 300, 302 may only intersect a portion of the channel 124, such that the long body 135 of the fastener 123 can pass though the channel 124 without moving the rollers 300, 302. When the short body 134 of the fastener 123 contacts each roller 300, 302, the roller 300, 302 may be driven out of the channel 124, i.e., laterally displaced, to allow passage of the short body 134. Similarly, FIG. 4 illustrates a configuration of cam members 400, 402, 404 which may act as guide members. The cam members 400, 402, 404 may intersect a portion of the channel 124 and may pivotally move relative to the channel when contacted by the short body 134 of the fastener.

FIGS. 5 and 6 illustrate spring steel members 500, 600, 602 having a first end affixed to a nose 122 and a second end positioned to intersect the channel 124. The spring steel members may move from the path of a fastener upon contact with the short body thereof. As is clearly evident from the illustrated embodiments, a variety of configurations of spring steel members may be utilized for movably intersecting at least a portion of the channel 124. For example, as shown in FIG. 5, the spring steel members 500 may be provided as generally linear members, at least a portion thereof extending into the channel 124. The spring steel members 500 may resiliently deflect under contact by the short body 134, allowing the short body 134 to pass through the channel 124. In a related manner, the spring steel members 600, 602 may also be provided including at least a portion thereof having an at least partially arcuate shape. Two such possible configurations are shown in FIG. 6.

Consistent with the various foregoing embodiments, the system may utilize one or more guide members capable of intersecting at least a portion of the channel, in at least one position of the guide members, to at least partially restrict or control the movement of the long body 135 relative to the channel 124 in at least one direction. The guide members may be movable relative to the channel to permit the passage of the short body 134 of the fastener 123. In the foregoing manner, the system may include a passage for driving a fastener having a first body portion, e.g., the long body 135, and a second body portion, e.g., the short body 134. The passage may include a first channel portion for receiving the long body 135 of the fastener 123. The one or more guide members may be movable to define a second channel portion for receiving the short body 134. In the illustrated embodiments, guide members may be moved, deflected, deformed, etc. to permit passage of the short body 134 when contacted by the short body 134. In various additional embodiments, the guide members may also be biased and/or moved by a power supply such as an air, gas, electric, or other power source.

Figure 7:
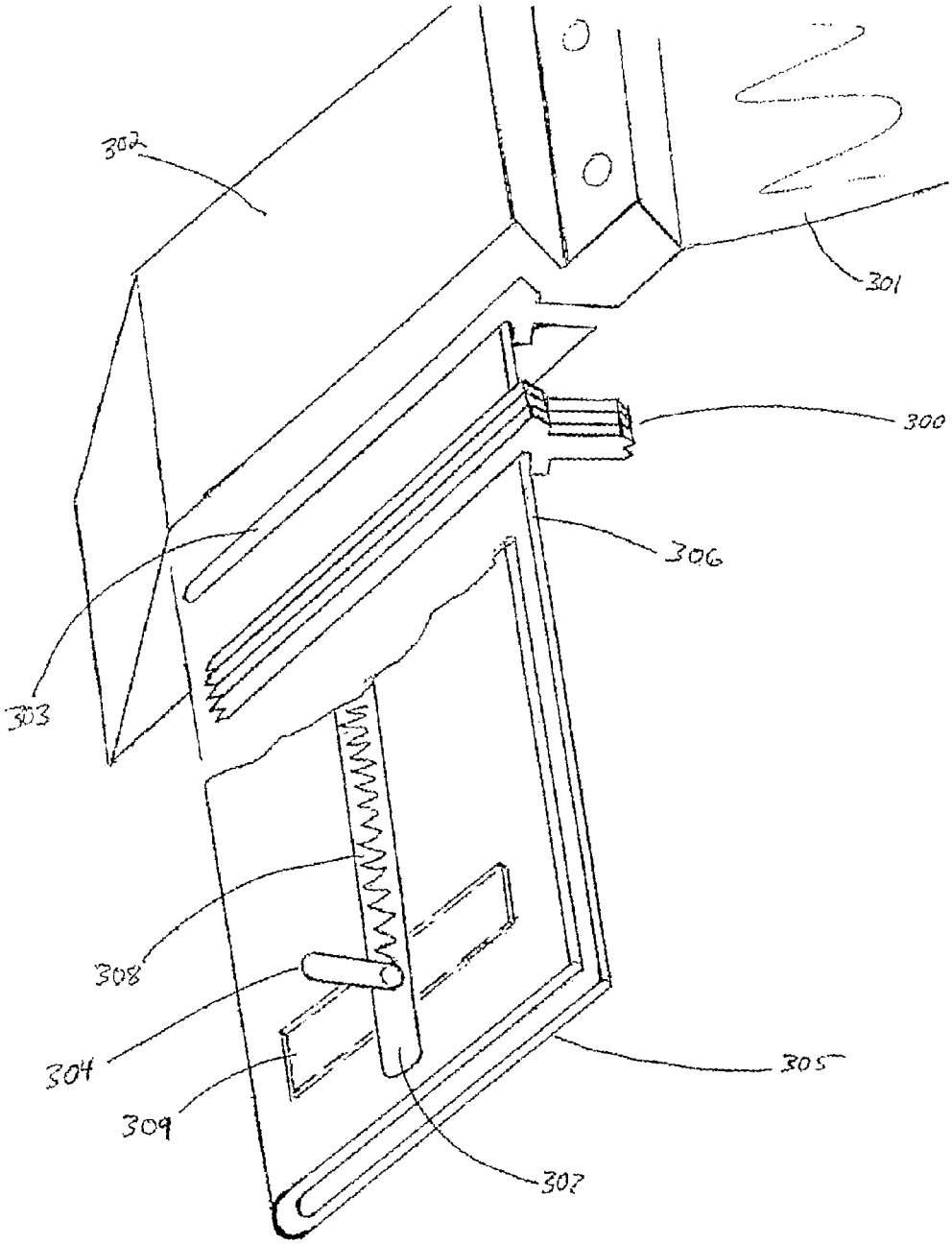
FIG. 7 is a perspective and partial sectional view of one exemplary embodiment of a magazine for guiding a plurality of fasteners in a system for driving a fastener consistent with the present invention.

Turning now to FIG. 7, there is illustrated an exemplary magazine 305 coupled to a nose 302 and affixed to a tool body 301 in a system consistent with the present invention. The nose 302 may be configured as described above, and the magazine 305 may be configured to receive a plurality of collated fasteners, e.g. a collated strip 300 of fasteners. The collated strip 300 of fasteners may include a plurality of separate fasteners secured to each other, e.g. by an adhesive, in a manner that allows separation of each fastener from the collated strip 300 as the fastener is driven through the nose 302 by the tool.

As shown, the nose 302 may include an opening 303 for receiving the fasteners and orienting the fasteners in the channel 124. The fasteners may be fed into the opening 303 by a pusher 309, which may be biased against the strip 300 of fasteners by a spring 308. The fasteners may ride along a guide rail 306, as shown. An opening 307 may be provided in the magazine to accommodate an external knob or handle 304 useful for retracting the pusher for loading the fasteners.

Figure 8:
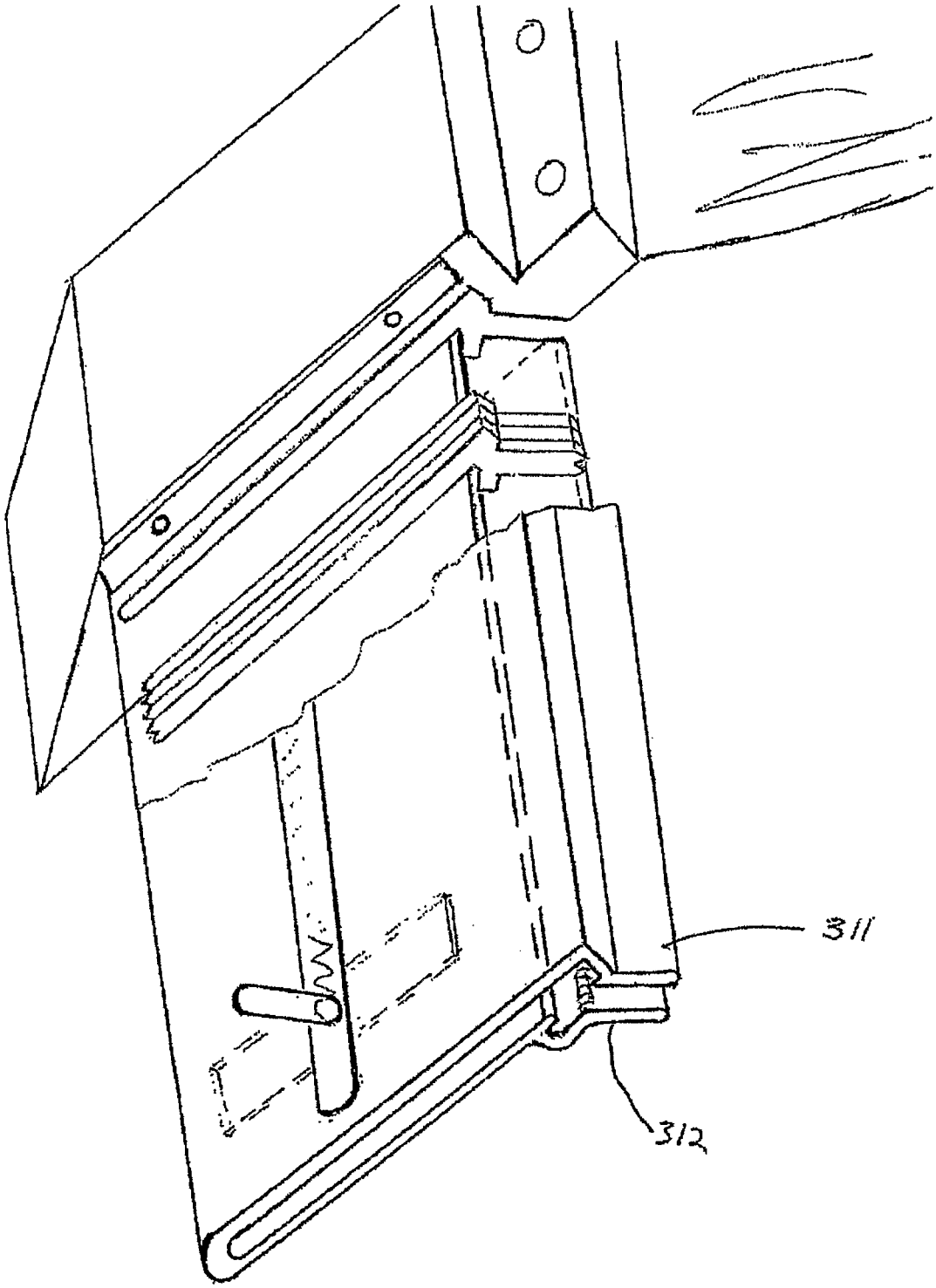
FIG. 8 is a perspective and partial sectional view of another exemplary embodiment of a magazine for guiding a plurality of fasteners in a system for driving a fastener consistent with the present invention.
Figure 9:
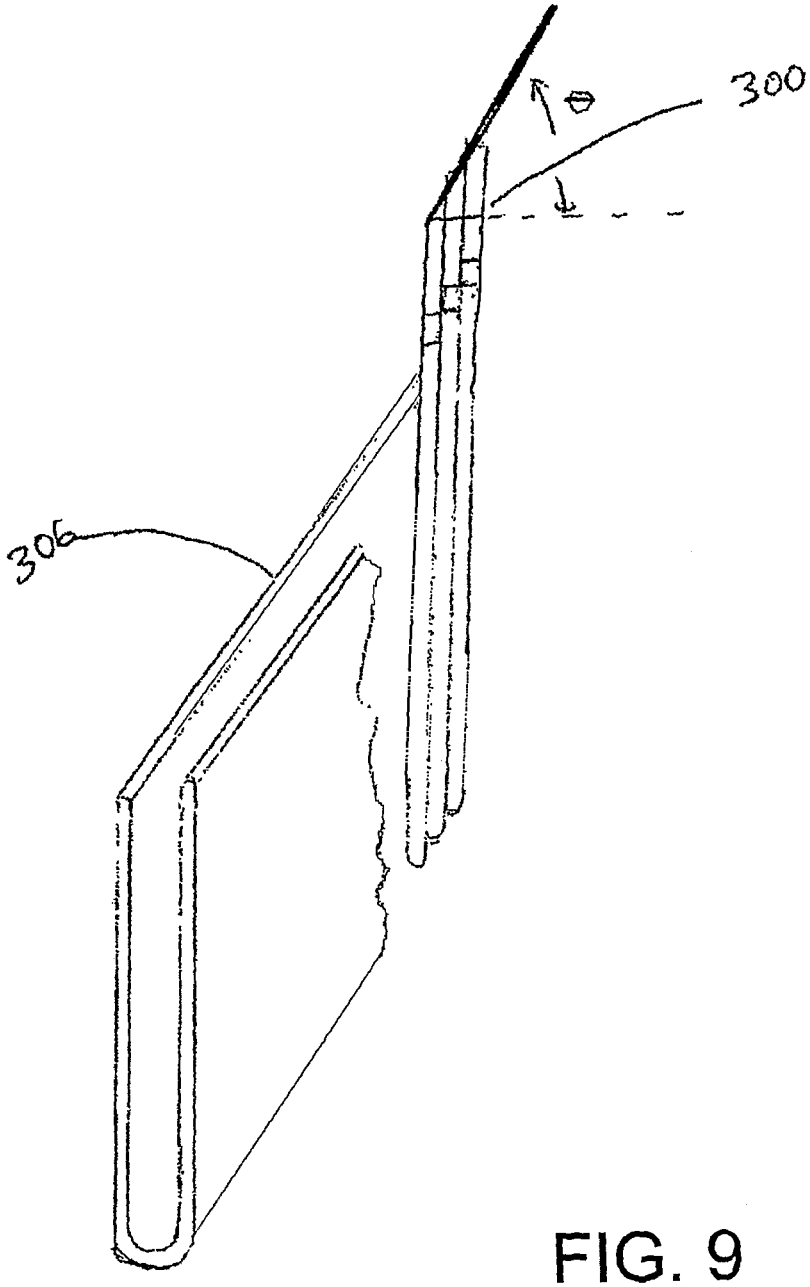
FIG. 9 is schematic illustration of another exemplary embodiment of a magazine for guiding a plurality of fasteners in a system for driving a fastener consistent with the present invention showing the fasteners collated in an offset or angular manner.

FIG. 8 illustrates an alternative magazine configuration including an extended top 311 and bottom rail 321 for enclosing and guiding the short body 134 of the fasteners. FIG. 9 illustrates an exemplary magazine configuration with a collated strip 300 of fasteners collated at an angle θ relative to each other to facilitate feeding of the fasteners into the nose.

Figure 15:
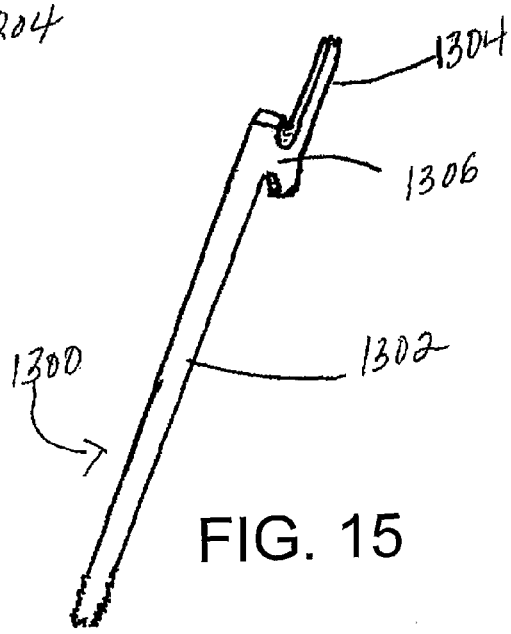
FIG. 15 is a perspective view of a fastener having an offset short body consistent with the present invention.

Turning to FIGS. 10 through 14, another exemplary embodiment of a system 1200 for driving a fastener consistent with the present invention is shown. The system 1200 is adapted for use with an offset fastener 1300, such as shown in FIG. 15. As depicted, the exemplary offset fastener 1300 may generally include a fastener main body 1302 and a fastener short body 1304. The fastener main body 1302 and short body 1304 may be obliquely angled relative to one another such that the main body 1302 and short body 1304 neither parallel nor perpendicular relative to one another. Additionally, the fastener main body 1302 and short body 1304 may be coupled via an offset 1306. The offset 1306 may laterally displace the main body 302 and the short body 1304 relative to one another, etc.

Figure 10:
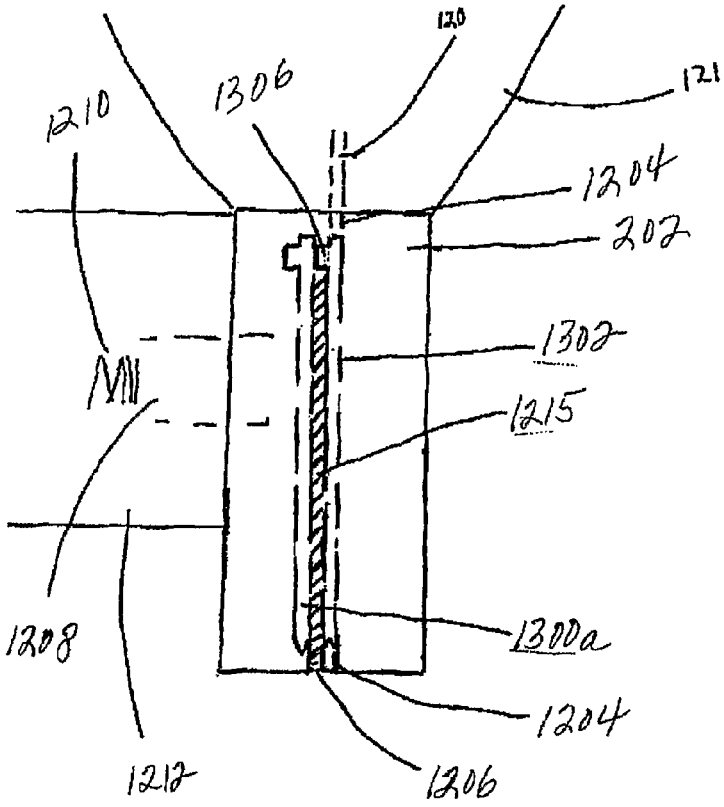
FIG. 10 is a partial sectional view of an exemplary embodiment of a system for driving an offset fastener consistent with the present invention.

As shown in FIG. 10, the system 1200 may generally include a tool body 121, which may include a commercially available apparatus for driving a fastener using a driver blade 120. The driver blade may be driven outwardly from the tool body 121 using pneumatic, electrical, mechanical, etc. driving means. For example, the tool body 121 may be a commercially available pneumatic or electrical nailer.

A nose 1202 may be coupled to the tool body 121 to align a first channel 1204 in the nose 1202 with the driver blade 120 of the tool body 121. The first channel 1204 may at least partially receive the driver blade 120 when the driver blade is driven outwardly from the tool body 121. The main body 1302 of a fastener 1300 may be at least partially received in the channel 1204 beneath the driver blade 120. The driver blade 120 may be driven outwardly from the tool body 121 to contact at least a portion of the fastener 1300 to force the fastener 1300 outwardly from the end 1206 of the nose 1202. The force applied by the driver blade 120 to the fastener 1300, as well as the outward travel of the driver blade 120 may be adapted to force the fastener 1300 from the nose 1202 to achieve a desired penetration depth of the fastener 1300 into a target member.

The fastener 1300 may be positioned in the first channel 1204 by a pusher 1208, which may be biased against one or more fasteners, e.g., by an associated spring 1210. In one embodiment, the pusher 1208 and spring 1210 may be associated with a magazine 1212, which may be coupled to the nose 1202 and may be adapted to deliver one or more fasteners 1300 to the nose 1202. The magazine 1212 may have a variety of configurations for delivering one or more fasteners 1300 to the first channel 1204 from a variety of positions relative to the tool body 121, e.g., from either side, the front, or the back of the tool body 121. For example, as shown a fastener 1300*a* may be positioned to be fed into the channel 1204 once the fastener 1300 has been driven from the channel 1204.

Figure 11:
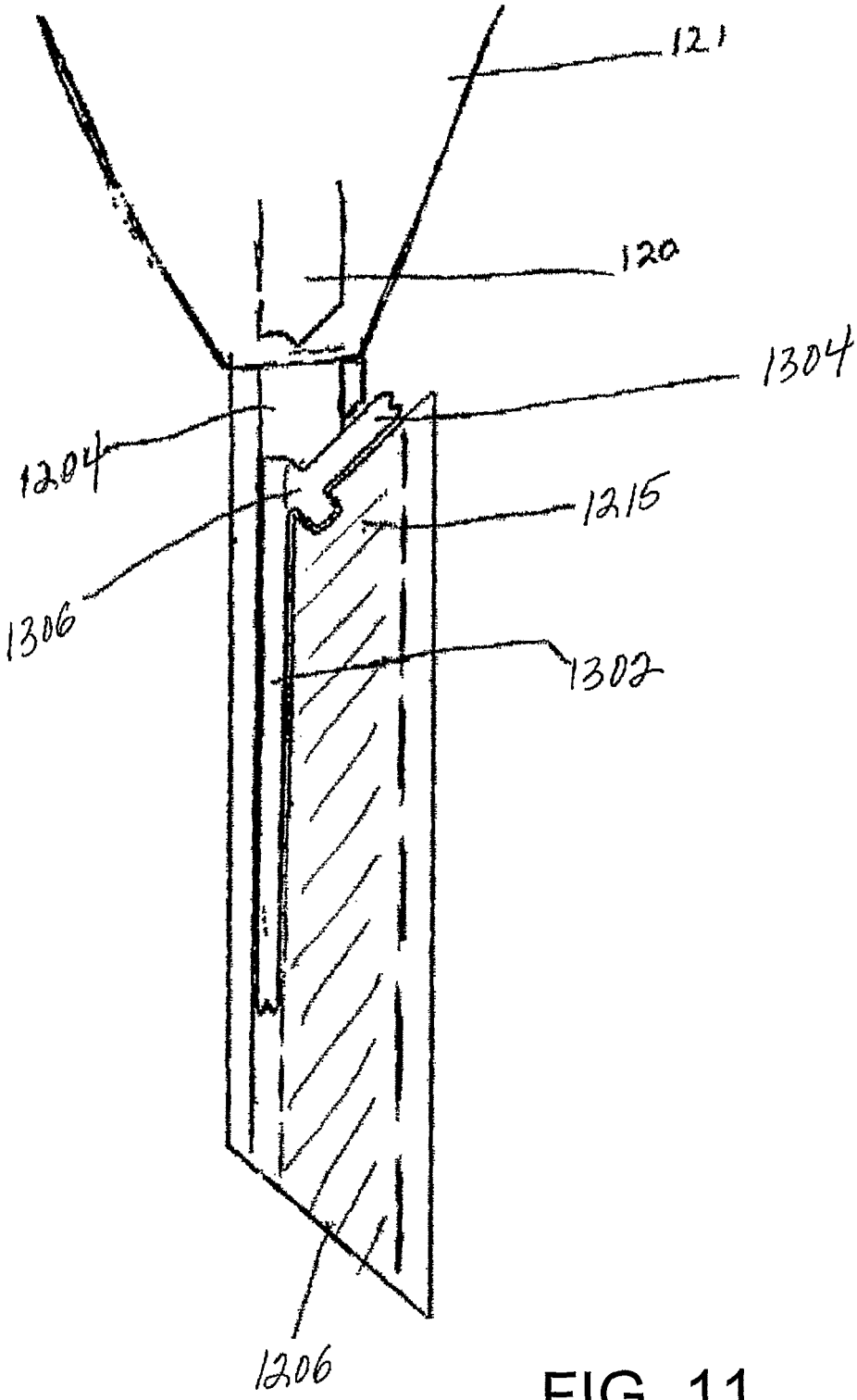
FIG. 11 is a cross-sectional side view of the system depicted in FIG. 10.
Figure 12A:
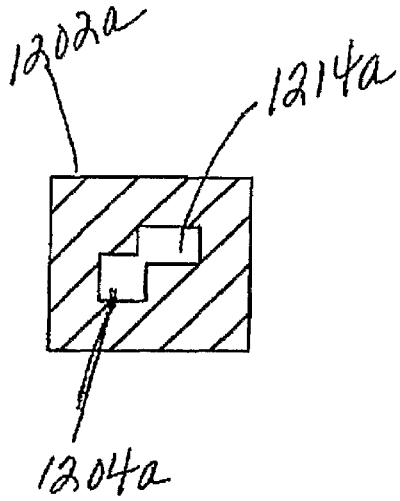
FIGS. 12*a*-12*c* depict top cross-sectional views of alternative configurations of a system for driving an offset fastener consistent with the present invention.
Figure 12B:
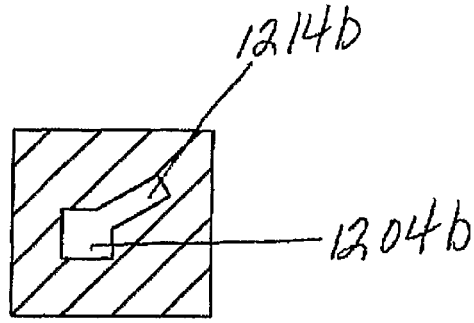
Figure 12C:
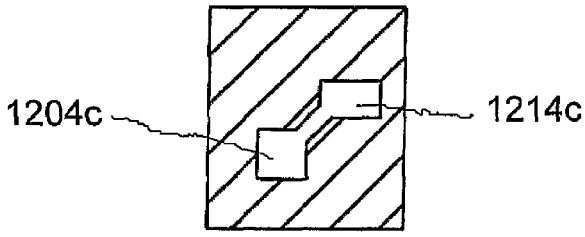

With additional reference also to FIGS. 11 and 12, the nose 1202 may include a second channel 1214 adapted to accommodate the short body 1304 of the fastener 1300. The first and second channels 1204, 1214 may intersect one another, e.g., to accommodate the offset 1306 of the fastener. As shown in FIGS. 10 and 11, the first and second channels 1204, 1214 may be separated by a web 1215, shown in the partial cross-sectional views in FIGS. 10 and 11. As shown in FIGS. 12*a*-12*c*, the geometry and orientations of the first and second channels 1204*a-c*, 1214*a-c* may vary according to different configurations of the fastener 1300. The at least partial intersection between the first and second channels 1204*a-c*, 1214*a-c* may accommodate the offset portion 1306 of the fastener 1300. Of course, the configurations depicted in FIGS. 12*a-c* are merely exemplary configurations. Numerous alternative configurations may also be provided consistent with the present invention.

The channels 1204, 1214 accommodating the main body 1302 and short body 1304 of the fastener 1300 may at least partially guide or stabilize the fastener 1300 in the nose 1202 and as the fastener is driven from the nose 1202. For example, the main body 1302 of the fastener 1300 may be disposed in, and travel through, the first channel 1204. The first channel 1204 may have geometry that may be generally complimentary to the geometry of the main body 1302 of the fastener 1300. Movement of the fastener 1300, other than axially through the channels 1204, 1214, may be at least partially restricted by the complimentary geometries of the main body 1302 and the first channel 1204. Furthermore, the main body 1302 of the fastener 1300 may be at least partially supported, e.g., against buckling upon impact with a target member, by the complimentary geometry of the first channel 1204. Similarly, or alternatively, the second channel 1214 may have a geometry that is generally complimentary to the short body 1304 of the fastener 1300, and may also at least partially restrict the movement of the fastener 1300 in the first and second channels 1204, 1214. As mentioned, the at least partial intersection between the first and second channels 1204, 1214 may accommodate the offset 1306 connecting the main body 1302 and short body 1304 of the fastener 1300, allowing the fastener 1300 to be forced down the channels 1204, 1214 and to be delivered from the nose 1202. Accordingly, consistent with the present invention a system is provided including a passage for driving a fastener having first and second body portions, i.e., offset main and short body portions 1302, 1302. The passage may include first and second channel portions adapted to receive first and second portions of the fastener.

Figure 13:
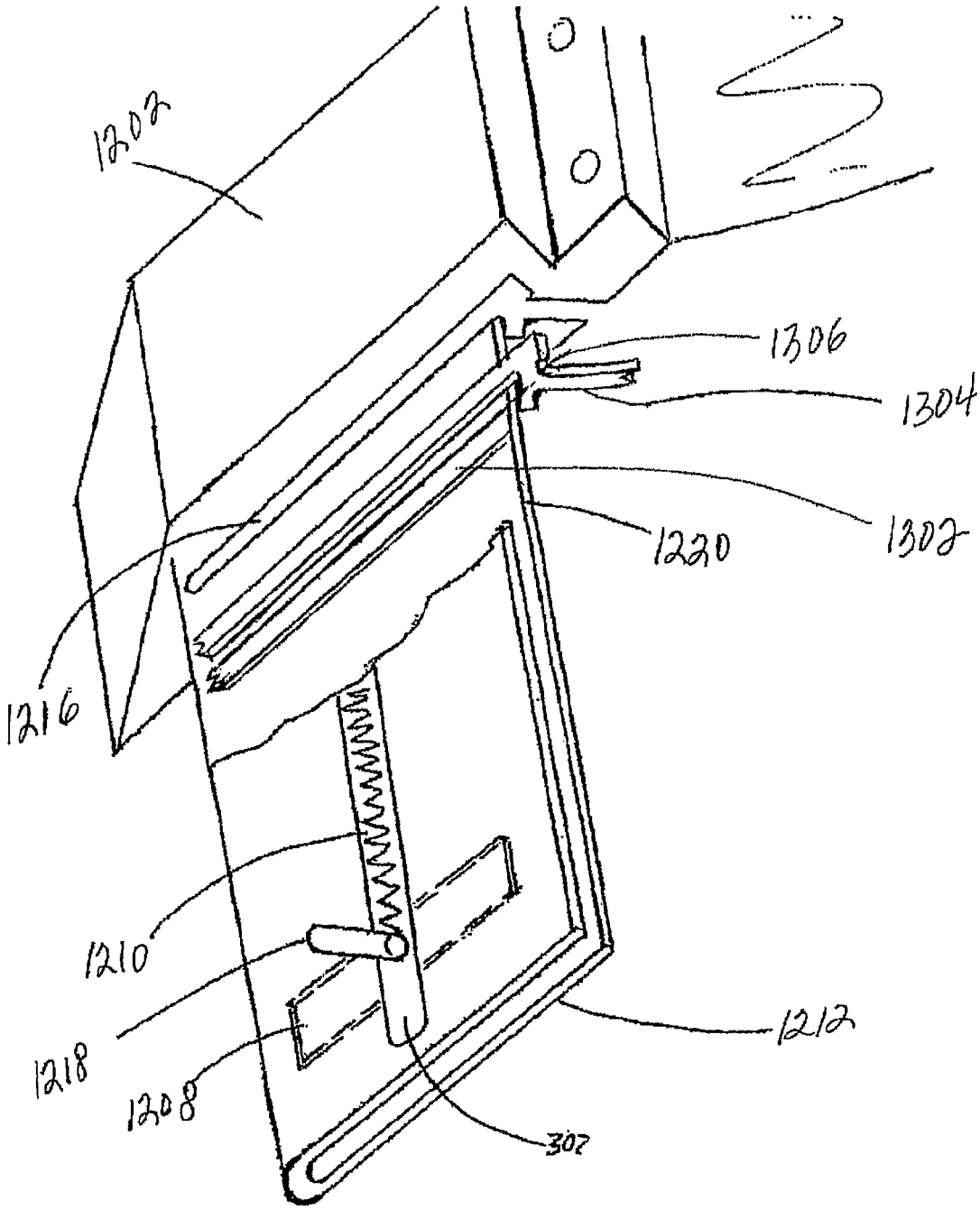
FIG. 13 is a rear perspective view of the system depicted in FIG. 10, showing an exemplary embodiment of a magazine for guiding a plurality of fasteners in a system consistent with the present invention.

Turning to FIG. 13, an embodiment of a side-feed magazine 1212 coupled to a nose 1202. The magazine 1212 may introduce fasteners 1300, e.g., from a collated strip of fasteners, into the nose 1202 via a receiving opening 1216. The opening 1216 may orient the fasteners 1300 relative to the first and second channels 1204, 1214 to be driven by the tool 121. As previously discussed, the fasteners may be biased toward the nose 1202, e.g., by a spring 1210 acting through a pusher 1208. As shown, the magazine 1212 may include a handle 1218 for retracting the pusher for loading fasteners 1300 into the magazine. The offset 1306 of the fastener 1300 may be carried on a rail 1220, thereby aligning the fasteners 1300 with the opening 1216.

Figure 14:
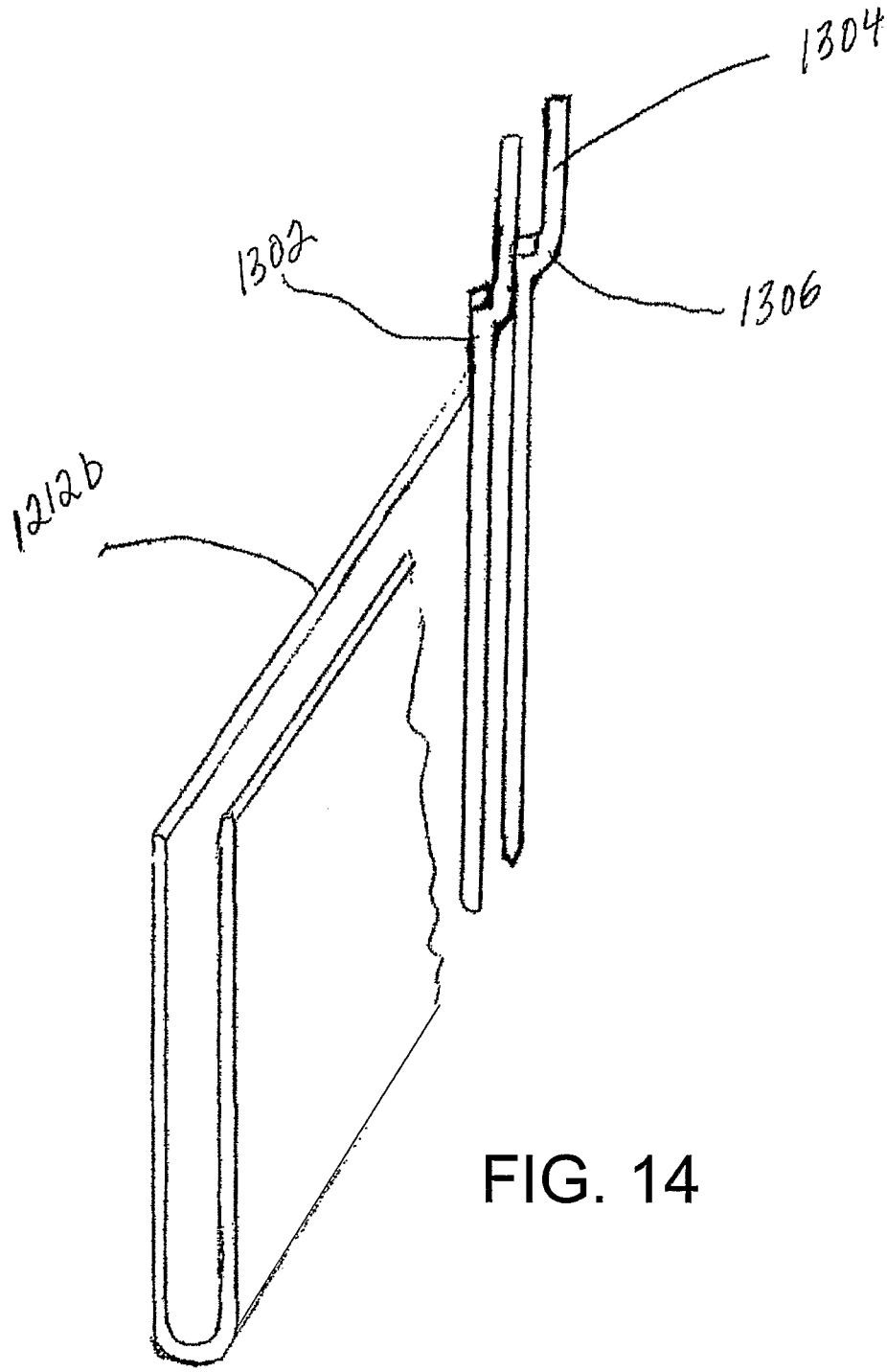
FIG. 14 is a schematic illustration of another embodiment of a magazine for feeding offset fasteners in a system consistent with the present invention.

FIG. 14 depicts another magazine 1212*b* adapted to deliver fasteners 1300*a*, 1300*b* to the back of the tool 1202. The magazine 1212*b* may be structurally similar to the magazine 1212 described with reference to the embodiment of FIG. 13. However, as shown in FIG. 14, the fasteners 1300*a*, 1300*b* may be oriented to be delivered to the first and second channels 1204, 1214 from a rear of the nose 1202.

According to one aspect, there is disclosed an apparatus for driving a fastener including a nose having a passageway including a first channel portion and a second channel portion. The first channel portion may be adapted to receive a first fastener body portion and the second channel portion may be adapted to receive a second fastener body portion. The first and second fastener body portions may be obliquely angled relative to one another. The apparatus may also include a driver blade configured to apply a force to a first end of the fastener for driving the fastener at least partially from the passageway.

According to another aspect, there is provided an apparatus for driving a fastener having a long body portion and a short body portion obliquely angled relative one another. The apparatus include a body defining a channel configured to receive the fastener therein. A driver blade is provided capable of forcing said fastener from an end of said channel. The apparatus may also include a guide member biased toward a first position intersecting at least a portion of the channel.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible.

What is claimed is:

1. An apparatus for driving a fastener comprising:

a nose comprising a passageway comprising a first channel portion and a second channel portion, said first channel portion adapted to receive a first fastener body portion and said second channel portion adapted to receive a second fastener body portion, said first and second fastener body portions being obliquely angled relative to one another; and a driver blade configured to apply a force to a first end of said fastener for driving said fastener at least partially from said passageway, and a guide member at least partially disposed in a pocket and intersecting only said second channel portion so that said guide member and said first channel portion at least partially restrict movement of said first fastener body portion other than along an axis of said first channel portion, wherein said driver blade is configured to force said first fastener body portion through said first channel portion and past said guide member without forcing said guide member into said pocket and said driver blade is configured to force said second body portion through said second channel portion and into contact with said guide member to force said guide member out of said second channel portion and into said pocket.

2. An apparatus according to claim 1, wherein said guide member comprises a pivotally movable member, said member biased toward said first position.

3. An apparatus according to claim 1, wherein said guide member comprises at least one laterally displaceable roller.

4. An apparatus according to claim 1, wherein said guide member comprises at least one cam feature pivotally movable between said first and second positions.

5. An apparatus according to claim 1, wherein said guide member comprises at least one resiliently deflectable member.

6. An apparatus according to claim 5, wherein said guide member comprises a spring member.

7. An apparatus according to claim 1, wherein said first and second channel portions comprise intersecting adjacent channels.

8. An apparatus according to claim 1, further comprising a magazine configured to sequentially deliver a plurality of fasteners to said nose.

9. An apparatus according to claim 8, said nose comprising an opening for receiving said fasteners from said magazine, said opening aligning said fasteners with said passageway.

10. An apparatus for driving a fastener having a long body portion and a short body portion obliquely angled relative one another, said apparatus comprising:

a body defining a channel having a first channel portion configured to receive said long body portion of said fastener and a second channel portion configured to receive said short body portion of said fastener;

a driver blade capable of forcing said fastener from an end of said channel; and a guide member biased toward and intersecting only said second channel portion so that said guide member and said first channel portion at least partially restrict movement of said long body portion other than along an axis of said first channel portion, wherein said driver blade is configured to force said long body portion through said first channel portion and past said guide member without forcing said guide member out of said second channel portion and said driver blade is configured to force said short body portion through said second channel portion and into contact with said guide member to force said guide member out of said second channel portion.

11. An apparatus according to claim 10, wherein said driver blade is configured to contact a top of said fastener to drive said fastener from said end of said channel.

12. An apparatus according to claim 10, wherein said body comprises an opening configured to receive said fastener and orient said fastener relative to said channel.

13. An apparatus according to claim 12, further comprising a magazine configured to sequentially deliver a plurality of fasteners to said channel through said opening.

14. An apparatus according to claim 13, wherein said magazine comprises a biased pusher capable of sequentially positioning said fasteners in said channel.

15. An apparatus according to claim 13, wherein said magazine comprises a guide rail, said fasteners being configured to ride on said guide rail for aligning said fasteners relative to said opening.

16. An apparatus according to claim 10, wherein said guide member is pivotally movable to intersect said second channel portion.

17. An apparatus according to claim 10, wherein said guide member comprises at least one roller laterally movable to intersect said second channel portion.

18. An apparatus according to claim 10, wherein said guide member comprises at least one cam feature pivotally movable to intersect said second channel portion.

19. An apparatus according to claim 10, wherein said guide member comprises at least one resiliently deflectable member.

* * * * *